US010578384B1

(12) United States Patent
Gwillim, Jr.

(10) Patent No.: US 10,578,384 B1
(45) Date of Patent: Mar. 3, 2020

(54) AMMUNITION COUNT SIGNALING IN RETROFIT APPARATUS FOR HANDGUN

(71) Applicant: Reese C. Gwillim, Jr., Boulder Creek, CA (US)

(72) Inventor: Reese C. Gwillim, Jr., Boulder Creek, CA (US)

( * ) Notice: Subject to any disclaimer, the term of this patent is extended or adjusted under 35 U.S.C. 154(b) by 0 days.

(21) Appl. No.: 16/421,929

(22) Filed: May 24, 2019

(51) Int. Cl.
*F41A 9/62* (2006.01)
*F41A 19/01* (2006.01)
*F41A 19/62* (2006.01)

(52) U.S. Cl.
CPC ..... *F41A 19/01* (2013.01); *F41A 19/62* (2013.01)

(58) Field of Classification Search
CPC ..... F41A 19/01
See application file for complete search history.

(56) References Cited

U.S. PATENT DOCUMENTS 5,033,217 A * 7/1991 Brennan ..... F41A 3/64 42/1.01
5,515,725 A 5/1996 Tabota et al.
5,735,070 A * 4/1998 Vasquez ..... F41A 9/62 42/1.02
6,490,926 B2 12/2002 Tabota
7,716,863 B1 5/2010 Johnson et al.
7,802,391 B2 9/2010 Quinn et al.
8,387,294 B2 * 3/2013 Bolden ..... F41H 13/00 42/1.01
9,316,461 B1 * 4/2016 Gwillim, Jr. ..... F41G 1/345
9,651,574 B2 5/2017 Rytkonen et al.
2003/0061753 A1 4/2003 Glock
2004/0200109 A1 * 10/2004 Vasquez ..... F41A 19/01 42/1.01
2008/0016744 A1 1/2008 Joannes et al.
2009/0211139 A1 * 8/2009 Ufer ..... F41A 19/01 42/1.03
2010/0139141 A1 * 6/2010 Pikielny ..... F41A 19/01 42/1.03
2016/0033221 A1 * 2/2016 Schmehl ..... F41A 33/00 42/90
2019/0024998 A1 * 1/2019 Chan ..... F41A 19/01

* cited by examiner

*Primary Examiner* — Gabriel J. Klein
(74) *Attorney, Agent, or Firm* — Thomas Schneck

(57) ABSTRACT

A circuit board that is added to a slide of an semiautomatic handgun for the purpose of counting fired rounds and providing a low ammunition round count signal, as well as a slide lock warning signal, indicating an out of ammunition condition. The circuit board is preferably saddle shaped with downwardly depending wings where warning lights can be located. The board is positioned between front and rear gun sights, below the aiming line of sight, with the saddle shape allowing placement of LEDs that can be seen behind the rear gun sight. In one embodiment, circuitry on the circuit board faces the slide so that the normal underside of the circuit board faces upwardly but below portions of gun sights that establish aiming.

11 Claims, 6 Drawing Sheets

AMMUNITION COUNT SIGNALING IN RETROFIT APPARATUS FOR HANDGUN

TECHNICAL FIELD

The invention relates to handgun safety apparatus and, more particularly to an aftermarket appliance for signaling low handgun ammunition counts.

BACKGROUND ART

In U.S. Pat. No. 7,716,863 Johnson et al. disclose an apparatus for counting and storing a number of rounds fired from a gun that includes a microcomputer; a non-volatile memory connected to the microcomputer; and a piezoelectric transducer connected to the microcomputer and mounted on the gun. The piezoelectric transducer has a power source that generates power during operation of the gun. The piezoelectric transducer may also sense the firing of the gun.

In U.S. Patent Application Publication 2009/0211139 Ufer et al. disclose a microcontroller operated module that is affixed to a firearm. The module includes an accelerometer for measuring the acceleration of each round fired by the firearm, a flash memory for storing the shot profile data that includes shot count and recoil data that is transmitted to a remote location.

In U.S. Patent Application Publication 2003/0061753 Glock discloses a pistol that includes a carriage or slide connected to a gun barrel. The carriage slides back on a handle of the pistol during discharge against the force of a return spring. The pistol includes a device for determining the number of shots fired with electronics attached to the handle. The electronics include a microprocessor with storage, a piezoelectric sensor connected to the microprocessor, a current supply, and a reading device for reading the storage that is external to the pistol. The piezoelectric sensor receives recoil impulses during discharge and sends a signal to the microprocessor in response to the impulses. A second sensor sends a second signal to the microprocessor when the carriage slides back. The microprocessor sends a count impulse to storage during a time interval between the first signal of the piezoelectric sensor and the second signal, which corresponds to the time interval between discharge and sliding back of the carriage during a discharge.

In U.S. Pat. No. 7,802,391 Quinn et al. disclose a handgun with a rounds counter that employs an accelerometer for counting rounds. The rounds counter is adapted to a variety of weapons, such as on military vehicles and patrol watercraft having different types of guns.

In U.S. Patent Application Publication 2008/0016744 Joannes et al. disclose a device for detecting and counting shots fired by an automatic or semiautomatic firearm with a barrel and a slider that undergoes accelerations in the axial direction for every fired shot. The accelerations form a signature for the firearm and the for type of ammunition. Electronics include an accelerometer with a passband and a microprocessor for analyzing the signals of the accelerometer. The microprocessor counts the number of shots fired using the signal of the accelerometer and the acceleration signature.

An object of the invention is to provide an aftermarket handgun ammunition count signaling apparatus.

SUMMARY DISCLOSURE

The above object is achieved with placement of a circuit board on a gun slide in a semiautomatic handgun of the type where the slide moves rearwardly over the gun barrel and then forwardly to battery position as long as there is ammunition. A thin circuit board is mounted on the semiautomatic handgun slide below the line of sight established by the gun sights. One portion of the circuit board has electronic circuitry for sensing slide acceleration rearwardly and reverse acceleration after ejection of a spent round. A counter associated with a microcontroller counts fired rounds based upon acceleration cycles. A low count generates an associated humanly perceptible signal from a transducer, such as an LED or other light, for signaling a round count at a preset level, such as two rounds remaining. The circuitry also includes logic that signals slide lock back in a rearward position, for example when ammunition is out, with a humanly perceptible signal, such as a second LED or other light, also issuing from a signal source on the circuit board. Lock back occurs when the last round of ammunition is fired or when there is a misfeed. All circuitry is carried on a thin saddle shaped circuit board, in one embodiment facing downwardly toward the slide, together with a thin battery that powers the circuitry. The saddle shape has portions that are wider than the rear gun sight. This allows the circuit board to be forward of the rear gun sight, yet the wider portions allow placement of LED lights that can be seen from behind the gun sight. The circuit board may be added to semiautomatic handguns as a safety feature after the time of manufacture. When the slide is locked back, the condition is easy to see in daylight but almost impossible to detect in the dark. Similarly low round count remaining is an important piece of information that can affect gun user safety. The circuit board carries rearwardly facing LEDs that indicate these conditions.

DETAILED DESCRIPTION

Figure 1:
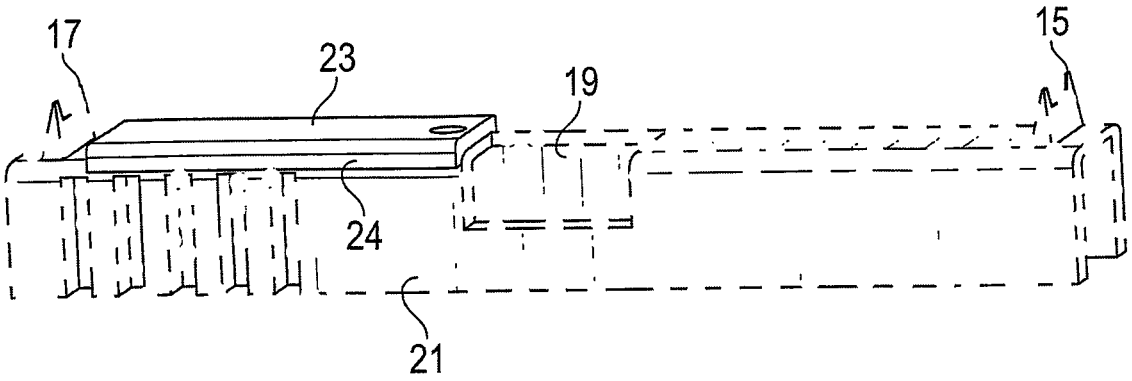
FIG. 1 is a side perspective view of a semiautomatic handgun slide shown in dashed lines with a circuit board of the invention in place atop the gun slide.

With reference to FIG. 1, a semiautomatic handgun, such as a Glock® brand gun, has a slide 21 with a front sight 15, a rear sight 17, an ejector opening 19 and a thin circuit board 23. The circuit board 23 resides well below the aiming portions of the gun sights 15 and 17. In one embodiment, by placing circuit board 23 in the upside-down position, a generally flat surface appears in the line of sight. The flat surface should be non-reflective and preferably absorptive of light, such as a black surface to avoid interference with aiming optics. The circuit board is preferably saddle shaped having small downwardly depending edge portions, like wing 24, that slightly wraps around the slide edge. In another embodiment, the circuit board is not in the upside-down position.

Figure 2:
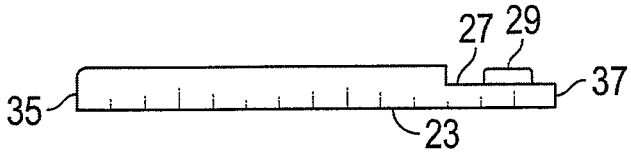
FIG. 2 is a side view of the circuit board of FIG. 1.
Figure 3:
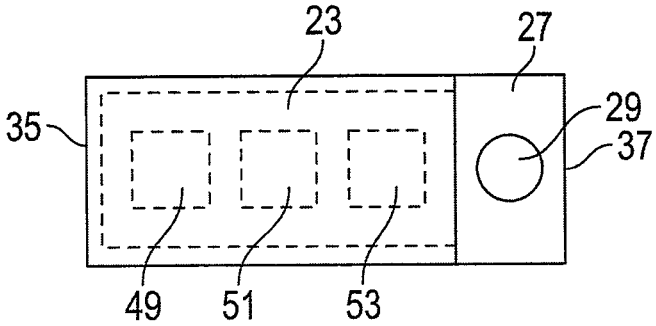
FIG. 3 is a top view thereof.

With reference to FIGS. 2 and 3, the circuit board 23 may be seen to have a slightly depressed forward portion 27 that carries reset button 29. A forward edge 37 of the board extends towards the forward sight on the slide, while a back edge 35 will be proximate to the rear sight. In FIG. 3, dashed line 49 shows placement of a battery on the underside of the board. Dashed line 51 indicates placement of a microcontroller and ancillary circuits shown in FIG. 7 on the underside of the board. Dashed line 53 indicates placement of an accelerometer on the underside of the board. The circuit board is adhered to the gun slide after the time of gun manufacture by secure bonding.

Figure 4:
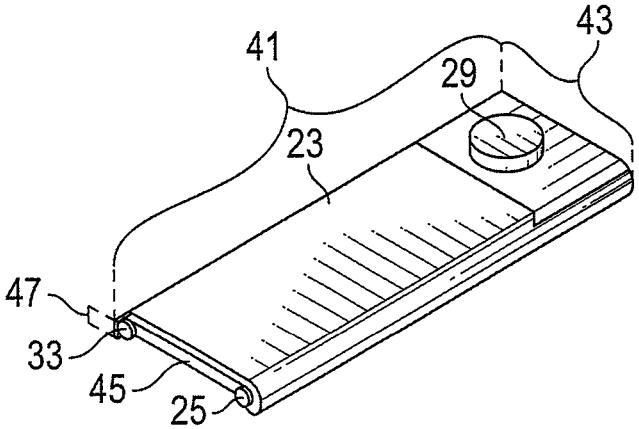
FIG. 4 is a perspective view thereof.
Figure 5:
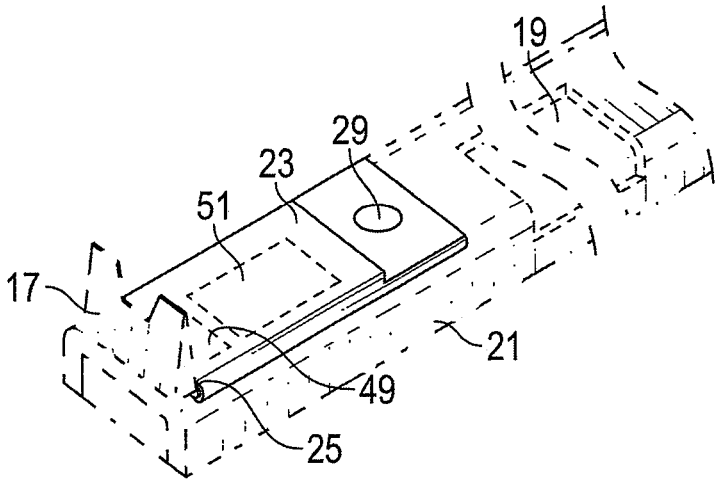
FIG. 5 is a perspective top view of a portion of a gun slide of FIG. 1 shown in dashed lines with the circuit board on top.

With reference to FIGS. 4 and 5, the circuit board 23 is adapted to be fastened to slide 21, for example, by adhesive or double-sided tape. The circuit board carrying integrated circuits has a cross sectional saddle shape with a wing height 47, a board length 41, a board width 43, and an integrated circuit thickness 45. For example, a fiberglass insulative circuit board could have a board thickness of approximately 2 mm and a circuit thickness of 1 mm.

A rearward board portion has the right-side LED light 25 as well as a left side LED light 33 symmetrically positioned on opposed side wings where the lights are not blocked by the rear sight. Because the LED lights are located on the side wings of the board, they are seen to the left and right of rear sight 17 and are visible behind the rear sight. It should be noted that while the circuit board is situated between the front and rear sights, signal lights in the side wings are visible to a shooter behind the slide and rear sight.

The topside of the circuit including a microcontroller and ancillary electronic circuits 51 and battery 49 are deposited, as well as an accelerometer, not shown. The thin film electronics circuitry are on the circuit board that is fastened to slide 21 associated with a semiautomatic handgun and move with the slide, thus experiencing the same acceleration as the slide. Reset button 29 is fabricated on a forward portion 27 of the circuit board. The forward portions is slightly recessed, by about half the board thickness, so that the button does not extend in height much above the board thickness 45 in order to avoid any interference with gun aiming optics.

Figure 6:
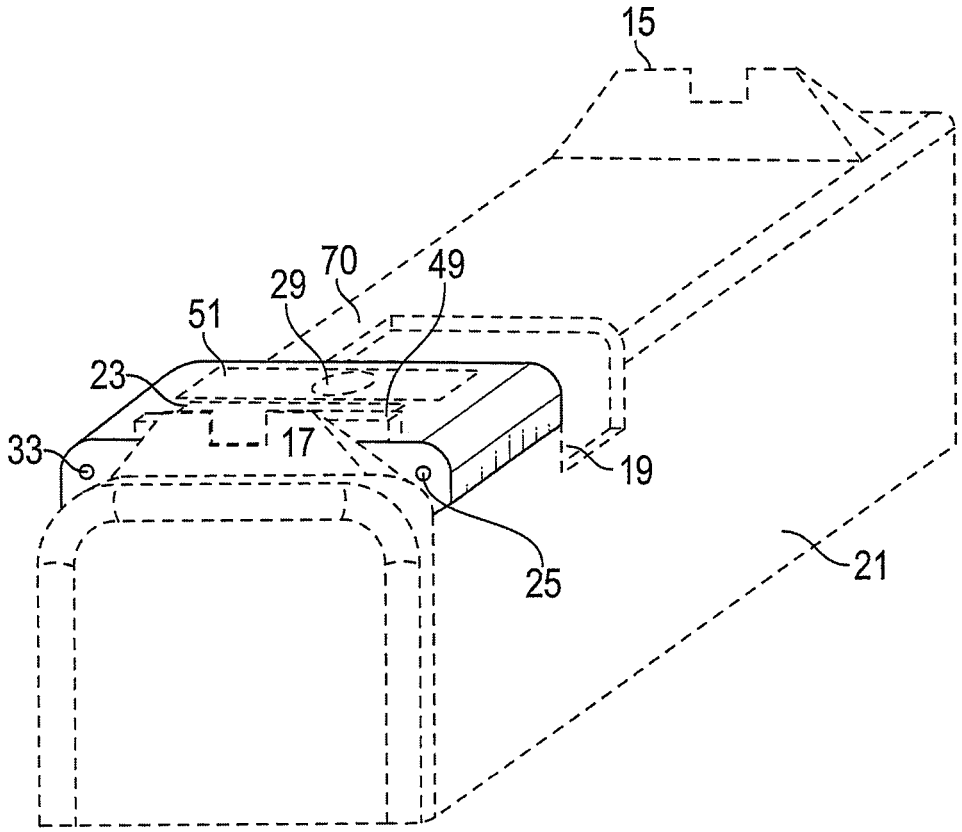
FIG. 6 is a perspective rearward view of the gun slide of FIG. 1 with the circuit board on top.

In FIG. 6, a rearward portion circuit board 23 abuts the forward side of rear sight 17. A forward portion of the circuit board 23 is approximately even with the rearward end of ejector 19. Right side LED 25 and left side LED 33 are proximate to electronic integrated circuitry 51, shown in dashed lines. Note that the circuit board 23 is between and below the line of sight established by rear sight 17 and forward sight 15. However, LEDs 26 and 33 can be seen behind the rear sight.

Figure 7:
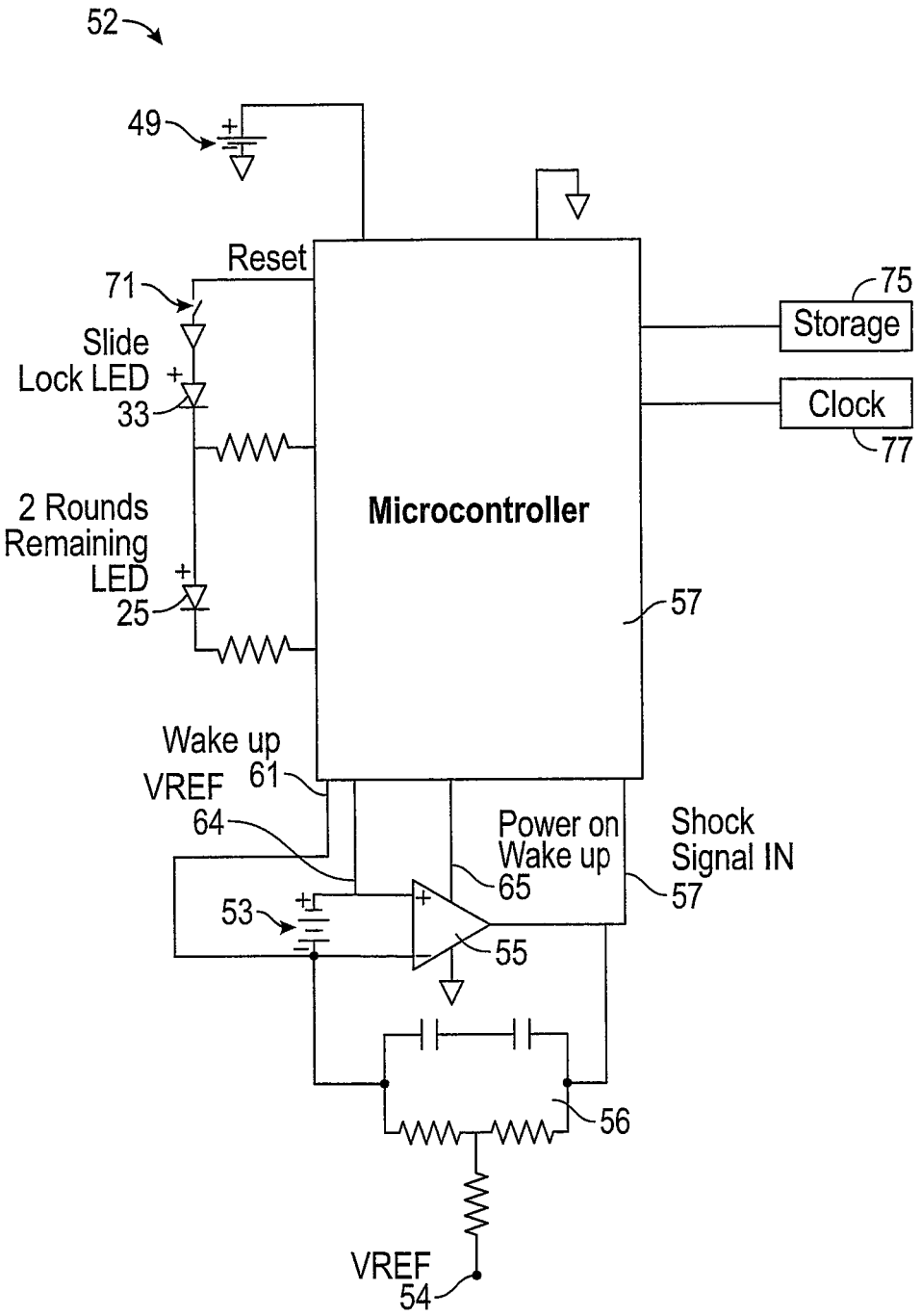
FIG. 7 is an electronic circuit that is carried on the circuit board of FIG. 1.

With reference to the circuit diagram of FIG. 7, a piezo thin film accelerometer 53, such as the automotive type used for airbag deployment is mounted on circuit board 52. For example accelerometer PKGS-00GXP1-R by Murata Mfg. Co. Ltd. is preferred. U.S. patents of Murata describing sensor construction are U.S. Pat. Nos. 5,515,725; 6,490,926; and 9,651,574, as examples. In the firing of a semiautomatic handgun round and subsequent shell ejection, slide motion roughly follows a sinusoidal trajectory where the gun slide starts out at rest, accelerates to a peak velocity as the slide moves in a rearward direction, towards the shooter, then slows and stops like the first half of a sine wave. Thereupon after shell ejection, the slide accelerates in the opposite direction within milliseconds, reaches a peak velocity, then slows and stops like the second half of a sine wave. The process is then repeated as another round is fired. The initial rearward acceleration may be thought of as the positive half of a sine wave, while the reverse acceleration may be thought of as the negative half of the sine wave. The accelerometer produces a positive signal for the rearward acceleration and a negative signal for the forward acceleration.

Correspondingly, the accelerometer produces electrical charge that is positive when acceleration occurs in the rearward direction and negative when acceleration occurs in a reverse direction. One side of the accelerometer 53, negative, communicates with a voltage reference amplifier 54, while the other side of the accelerometer, positive, goes to a positive input of an operational amplifier 55. A feedback network 56 is a charge accumulator that stores charge from accelerometer 53 initial motion then feeds the charge around the operational amplifier 55 which boosts the signal through one of its inputs and provides an output to microcontroller 57 at terminal 59.

A positive side of the accelerometer 53 is also connected to voltage reference 54, along line 64. In other words, the same voltage reference 54 is now provided to microcontroller 57 and to the positive terminal of operational amplifier 55. The operational amplifier serves as an A-to-D converter with the accelerometer providing an analog input. A negative terminal of accelerometer 53 provides a wake-up signal to microcontroller 57 at terminal 61. One of the main functions of the wake-up signal is to prolong the life of power supply battery 49. The wake-up signal allows power from the battery to flow to a power-on-wake-up signal line 65 that enables operational amplifier 55 to produce a digital shock signal at terminal 59, with origins at accelerometer 53. This signal is used to detect and count shots fired.

One of the primary functions of the microcontroller is to illuminate warning lights 25 and 33, both LEDs. The microcontroller 57 includes a counter whereby it knows the number of rounds of the fully loaded handgun and can count down as rounds are fired. The microcontroller uses shock signal inputs at terminal 59 to count down as shots are fired. When there are two rounds remaining, the light 25 is illuminated. The slide lock light 33 is illuminated when the microcontroller detects accelerometer motion in the positive direction but fails to detect an opposed negative accelerometer motion within a few milliseconds, indicative of slide lock back. Operation of the microcontroller is governed by a program in storage memory 75 explained by the logic diagrams of FIGS. 8-11. A clock 77 provides synchronization of the program and digital signals. A reset switch 71 can reset operation of the device, for example, when a misfed round is cleared on a lock back condition.

Figure 8:
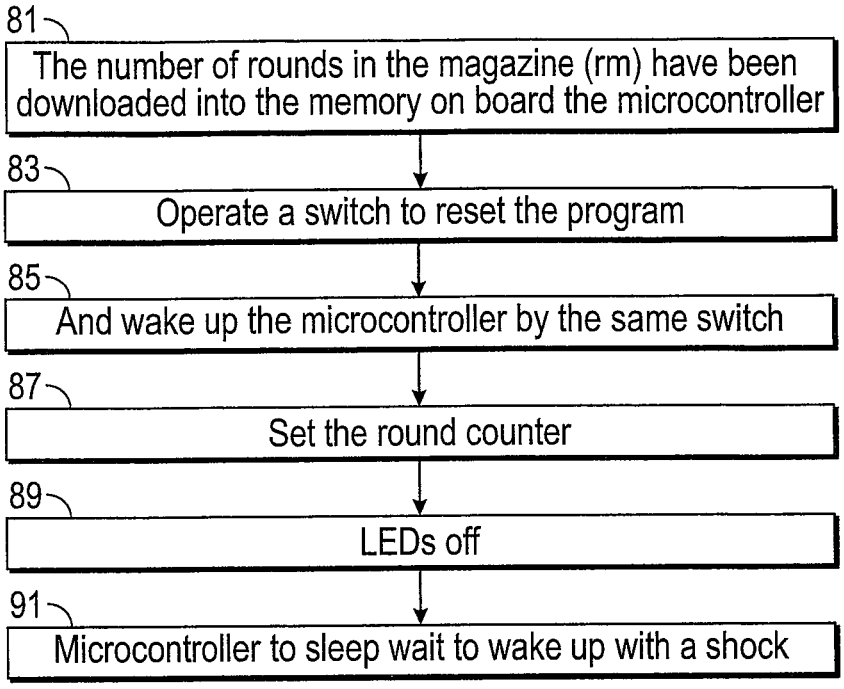
FIGS. 8-11 are logic diagrams for operation of the circuit of FIG. 7.

With reference to FIGS. 8-11, operation of the invention may be seen with reference to the logic diagrams. In FIG. 8, block 81 indicates that the number of rounds in the magazine have been stored in the memory associated with the microcontroller. Block 83 indicates that the reset switch signal initiates the computer program. Block 85 indicates that the microcontroller is also activated by the reset switch. The rounds counter is set to the number rounds in the handgun magazine, indicated by block 87. The lights 25 and 33 are off, indicated by block 89. The microcontroller is allowed to sleep, indicated by block 91.

Figure 9:
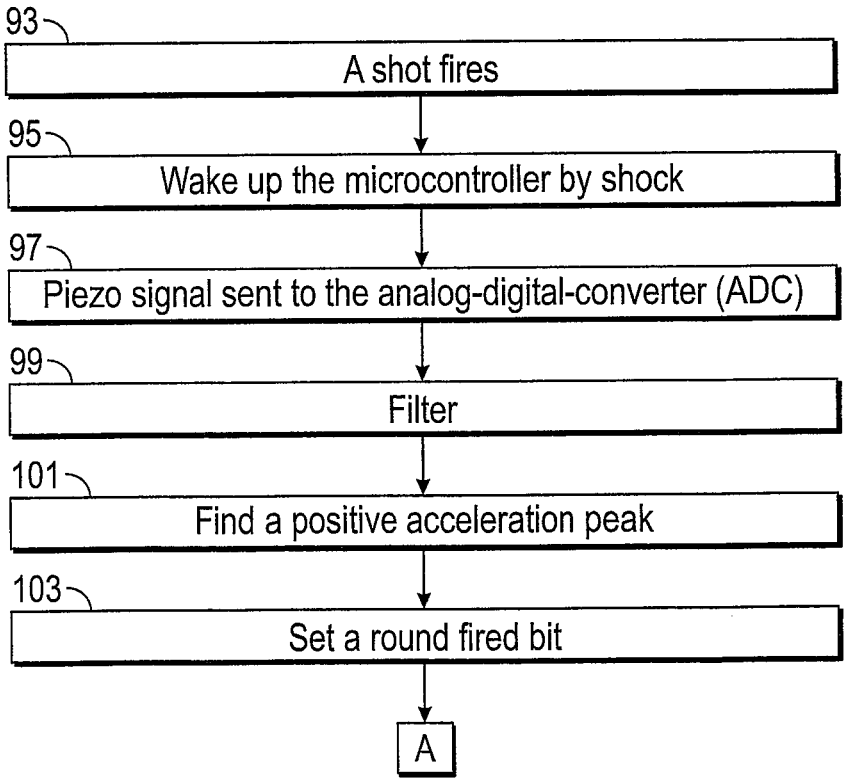

With reference to FIG. 9, the firing of the shot is indicated in block 93. The shot wakes up the micro controller, indicated by block 95. A piezo signal is generated by the accelerometer and sent to the A-to-D converter indicated by block 97. The feedback network filters the accelerometer signal indicated by block 99 and a shock signal is generated, indicated by block 101, that sets a round fired count indicated by block 103.

Figure 10:
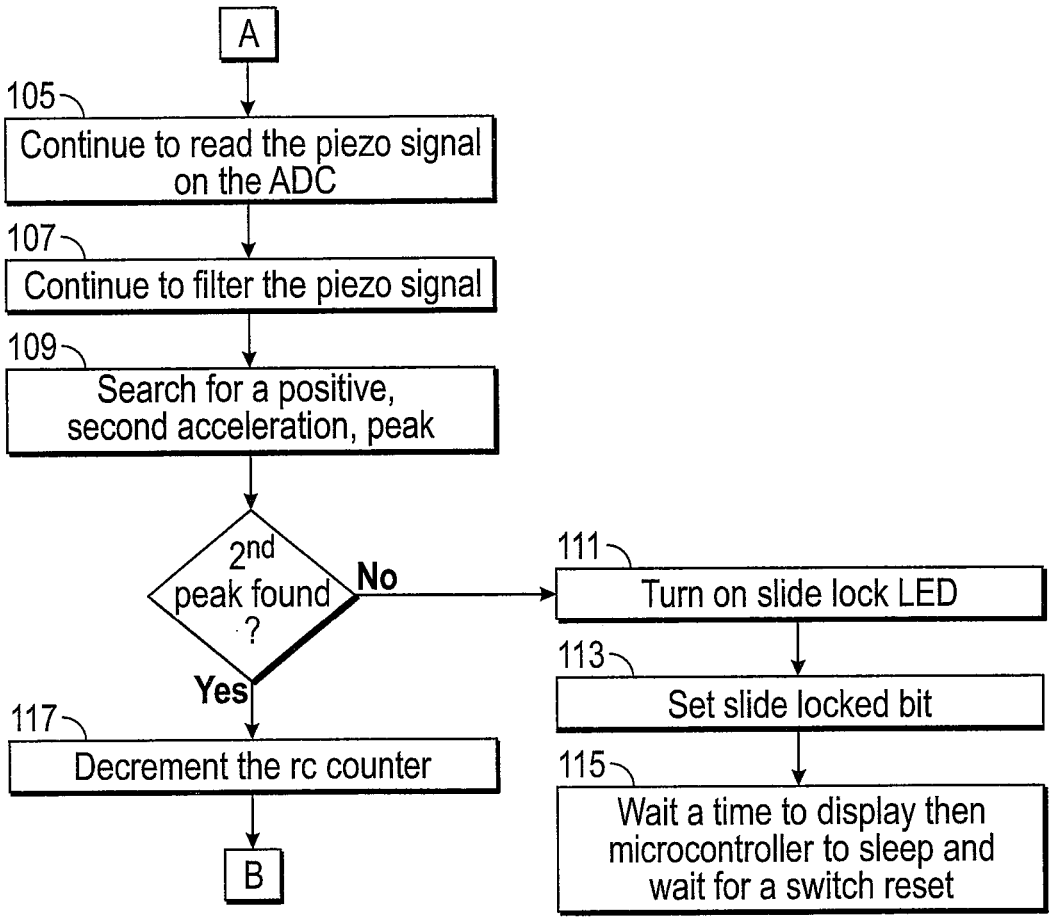

In FIG. 10, round counting is continued. The piezo accelerometer is read, making further counts, with positive peaks indicated by blocks 105 and 107 as the slide accelerates first in one direction and, within a few milliseconds, in the reverse direction as the slide goes the other way. In each case, there should be a pair of closely spaced accelerations. If no second acceleration is found within a preset short time, the slide lock light 33 is illuminated, indicated by block 111. In this situation the microcontroller sets a bit indicating slide lock, indicated by block 113, and awaits a reset, indicated by block 115. If the second acceleration is found, the round counter is decremented by one, indicated by block 117.

Figure 11:
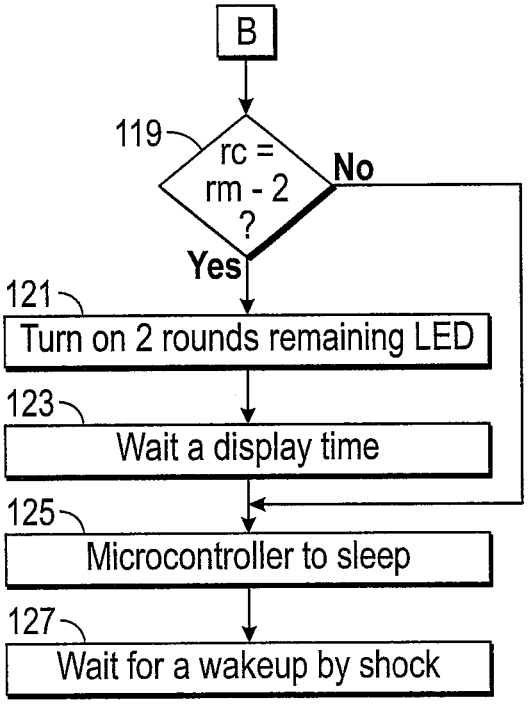

With reference to FIG. 11, a counter module in the microcontroller is looking for a preset low round count, in this case two rounds remaining, indicated by block 119. When this condition is reached a low round count lamp is illuminated, indicated by block 121. This lasts for a preset display time, or until reset, indicated by block 123. The microcontroller then goes to sleep, or goes to sleep if the preset low round count has not been reached, indicated by block 125. The microcontroller then waits for a wakeup signal from a piezo signal indicated by block 127.

The slide lock LED is preferably red, while the low round remaining LED is another color, say yellow, so that the warning signals can be distinguished in darkness, although both are simultaneously potentially visible on either side of, and from behind, the rear gun sight. It is not necessary to use LEDs. Any humanly perceptible warning signal could be used, preferably visual. The reset signal is only reliable after a full reload.

All circuitry is fabricated as thin film integrated circuits and mounted on the circuit board. Total thickness of the integrated circuits on the board is between one and two mm so that the thickness of the board and the thickness of the integrated circuits is less than 4 mm, the nominal clearance for the aiming line of sight of the handgun.

The integrated circuitry has a top insulative layer so that the metallic slide cannot short the circuitry if the circuitry contacts the slide when the circuit board is mounted upside down. In this case, a slight air gap exists between the electronic circuitry and the slide so that the piezo accelerometer is not biased by mechanical contact with anything, although insulated from contact with the slide by protective coatings. The saddle shape of the circuit board allows for a slight air gap between the circuit board and the gun slide while still preserving the line of sight established by the gun sights.

What is claimed is:

1. A signaling system for a semiautomatic handgun having a reverse and forward reciprocating slide having spaced apart upright forward and rearward gun sights establishing a line of sight for aiming comprising:

a circuit board having an accelerometer and circuits electrically communicating acceleration to signal LEDs on the board, wherein the signal LEDs are first and second LEDs spaced apart on opposite sides of the rear gun sight, including the first LED signals a low number of remaining rounds of ammunition and the second LED signals an interrupted firing cycle, the first and second LEDs visible from behind the rearward gun sight, the circuit board joined to the slide between forward and rearward gun sights with the accelerometer and circuits on a first side of the circuit board and a second opposite side of the circuit board, wherein the circuit board has a cross sectional saddle shape with downwardly depending wings with an overall height of the board on the slide below the line of sight of the handgun, the first and second LEDs mounted in the wings.

2. A semiautomatic handgun with a reverse and forward reciprocating slide having spaced apart forward and rearward gun sights establishing a line of sight for aiming comprising:

a circuit board mounted between forward and rearward gun sights and joined to the slide having expended round counting circuits mounted on a first side of the board facing the slide and a first warning light associated with the round counting circuits to display a low ammunition condition, the board having a second side opposite to the first side and facing away from the slide, wherein the circuit board has a cross sectional saddle shape with two opposed downwardly depending wings where first and second warning lights are located, the circuit board having a height on the slide between the gun sights that is below the line of sight for aiming, the first warning light visible to a shooter behind the rearward gun sight.

3. An apparatus for signaling safety conditions in a semiautomatic handgun having a reciprocating slide with upright gun sights of a nominal height comprising:

a circuit board having a length, width, height, thickness, a first circuit board side carrying circuitry and having a second side opposite the first side, the board mounted on a top of a handgun slide between the upright gun sights, the circuit board length extending from a rear sight to an ejector of the handgun, the board first side carrying an accelerometer sensor with associated circuitry reading slide accelerations within a specified time thereby defining a fired round count signal, the circuitry including a counter receiving and counting round count signals and a logic module signaling a first acceleration without another acceleration within said specified time thereby defining an interrupted firing cycle, the circuit board and circuitry having a combined height below a line of sight established by the upright gun sights;

a pair of visual output transducers in electrical communication with the circuit board, a first of the transducers connected to the counter adapted to signal with a first visual signal designating a round count at a preset level and a second of the transducers connected to the logic device adapted to signal with a second visual signal designating an interrupted firing cycle, the first and second visual signals visible behind the slide.

4. The apparatus of claim 3 wherein the first side of the circuit board faces the slide and the second side faces away from the slide.

5. The apparatus of claim 3 wherein the circuit board is attachable to the slide of a handgun after the time of manufacture of the handgun.

6. The apparatus of claim 3 wherein the thickness of the circuit board is less than one millimeter in line between the upright gun sights.

7. An apparatus for signaling safety conditions in a semiautomatic handgun having a reciprocating slide with upright gun sights of a nominal height comprising:

a circuit board having a length, width, height, thickness, a first circuit board side carrying circuitry and having a second side opposite the first side, the board mounted on a handgun slide, the board first side carrying an accelerometer piezo thin film sensor with associated circuitry reading slide accelerations within a specified time thereby defining a fired round count signal, the circuitry including a counter receiving and counting round count signals and a logic module signaling a first acceleration without another acceleration within said specified time thereby defining an interrupted firing cycle, wherein the circuit board has a cross sectional saddle shape with opposed downwardly depending wings, the circuit board and circuitry having a combined height below a line of sight established by the upright gun sights; and a pair of visual output transducers in electrical communication with the circuit board, a first of the transducers connected to the counter adapted to signal with a first visual signal designating a round count at a preset level and a second of the transducers connected to the logic device adapted to signal with a second visual signal designating an interrupted firing cycle, the first and second visual signals visible behind the slide.

8. The apparatus of claim 3 wherein the accelerometer sensor is a sensor suitable for use in automobiles.

9. The apparatus of claim 3 where the circuit board carries a thin film battery proximate to said associated circuitry.

10. The apparatus of claim 3 wherein the circuit board has a reset button projecting from the underside of the circuit board and associated with said counter.

11. The apparatus of claim 3 wherein the combined height of the circuit board and the circuitry atop the board is less than 4 mm.

* * * * *